US007270168B2

(12) United States Patent
Meyer et al.

(10) Patent No.: US 7,270,168 B2
(45) Date of Patent: Sep. 18, 2007

(54) METHOD FOR MOULDING LIGHT ALLOY CAST PARTS, IN PARTICULAR CYLINDER BLOCKS

(75) Inventors: Philippe Meyer, Ronquerolles (FR); Franck Plumail, Osny (FR)

(73) Assignee: Montupet S.A., Clichy (FR)

( * ) Notice: Subject to any disclaimer, the term of this patent is extended or adjusted under 35 U.S.C. 154(b) by 0 days.

(21) Appl. No.: 10/519,421

(22) PCT Filed: Jun. 20, 2003

(86) PCT No.: PCT/FR03/01899

§ 371 (c)(1),
(2), (4) Date: Oct. 24, 2005

(87) PCT Pub. No.: WO04/000486

PCT Pub. Date: Dec. 31, 2003

(65) Prior Publication Data

US 2006/0175033 A1 Aug. 10, 2006

(30) Foreign Application Priority Data

Jun. 21, 2002 (FR) ..... 02 07782

(51) Int. Cl.

| | |
|---|---|
| ***B22D 19/08*** | (2006.01) |
| ***B22D 15/02*** | (2006.01) |
| ***B22D 37/00*** | (2006.01) |
| ***B22D 33/04*** | (2006.01) |

(52) U.S. Cl. ..... 164/98; 164/127; 164/133; 164/137; 164/340; 164/359

(58) Field of Classification Search ..... 164/127, 164/351–357, 137, 339–343, 9–11, 98–112, 164/133, 359

See application file for complete search history.

(56) References Cited

U.S. PATENT DOCUMENTS

| | | | | |
|---|---|---|---|---|
| 2,783,510 | A * | 3/1957 | Dolza et al. | 164/137 |
| 5,297,611 | A * | 3/1994 | Legge et al. | 164/353 |
| 5,771,955 | A * | 6/1998 | Helgesen et al. | 164/9 |
| 5,954,113 | A * | 9/1999 | Buchborn | 164/61 |
| 6,527,039 | B2 * | 3/2003 | Shade | 164/137 |
| 6,837,297 | B1 * | 1/2005 | Dakan et al. | 164/98 |
| 2003/0000677 | A1 * | 1/2003 | Goya Arcelus et al. | 164/355 |

FOREIGN PATENT DOCUMENTS

JP 64-15267 * 1/1989

* cited by examiner

*Primary Examiner*—Kuang Y. Lin
(74) *Attorney, Agent, or Firm*—Blakely Sokoloff Taylor & Zafman

(57) ABSTRACT

The invention concerns a method for casting a part made of metal alloy such as an aluminum alloy comprising the following steps: forming a core (N, PNC) having at least one shaft (PC) designed to form in the part a cylinder and at least one cavity (P) designed to form in the part a support and/or retaining zone for a working member, and at least a cooling unit (RE) proximate to the cavity; positioning the core in a metal mould cavity, and feeding the mould lined with its liquid alloy core by gravity. The invention is particularly useful for casting internal engine cylinder blocks with aluminum cylinders with improved geometrical and mechanical properties of the crankshaft bearing zones.

12 Claims, 3 Drawing Sheets

METHOD FOR MOULDING LIGHT ALLOY CAST PARTS, IN PARTICULAR CYLINDER BLOCKS

The present patent application is a non-provisional application of International Application No. PCT/FR2003/001899, filed Jun. 20, 2003.

BACKGROUND

1. Field

This invention generally relates to the casting of primarily aluminum-based light alloy foundry parts.

Various foundry techniques are known, essentially those applied from the top of the mold in gravity mode and from the bottom of the mold in low-pressure mode. Various types of molds, primarily sand and metal molds, are also known.

2. Description of the Related Art

The use of gravity casting in metal molds has advantages for the production of foundry parts such as aluminum-alloy cylinder blocks for motor vehicle combustion engines or the like. In particular, such a method is suitable for small and medium series, because it is highly modular and minimizes the use of chemically-bound sand by the use of metal die walls.

In comparison with the casting technique for green sand molds, the gravity casting technique for metal molds has the advantage of an investment cost that is progressive, adapted and adjustable according to the actual production requirements.

However, the method for gravity metal mold casting of cylinder blocks, as conventionally practiced, does not enable a sturdy product of high metallurgical quality to be obtained in areas of the part such as the crankshaft bearings (areas that are more sensitive in terms of fatigue strength) while maintaining adequate dimensional control of the internal shapes with respect to one another.

Indeed, if one of these objectives is achieved, it is always to the detriment of the other.

For example, in reference to FIG. 1 of the drawings, if the gravity casting of a cylinder block in a V-shape is performed, with the crankshaft bearings PV in the upper portion, the situation is especially favorable for dimensional control of the barrels, in particular when liners inserted during casting are to be overmolded.

Indeed, the base of the mold makes enables all of the devices for guiding the metal pins, which form the barrels, to be placed in direct contact with the solidified alloy, or the metal pins that serve as a support for the liners CH to be placed on these barrel pins and themselves overmolded by the liquid alloy.

Similarly, this mold base can serve as a very practical support for the positioning of internal cores such as those intended to enable water to circulate.

However, it should be noted that these advantages of upwardly casting the block with crankshaft bearings are limited by the fact that, since the crankshaft bearings are under the risers MA, their metallurgic quality (in particular in terms of microporosity), mechanical characteristics and fatigue strength are significantly reduced with respect to what could be obtained with a faster cooling of the alloy.

If, on the other hand, the cylinder block is cast with the mold positioned in the other direction (i.e. with the crankshaft bearings downward) in order to promote the production of microconstructions and improved properties in the critical areas in terms of fatigue, there will be other difficulties if conventional gravity casting is used.

Indeed, in reference to FIG. 2, where a schematic cross-section of the mold is shown, it is necessary to provide a metal pin system to ensure that the stripping can occur in two directions D and D' shown in FIG. 2, or a liner-holder pin system, which the necessary integration with a risering system would be extremely difficult to carry out.

For this reason, such an approach is almost never used.

SUMMARY

The aim of the present invention is to overcome these limitations of the known prior art, and to propose a improved casting method that makes it possible to achieve the objectives of optimizing the mechanical characteristics, in particular in terms of fatigue, in areas such as the crankshaft bearings of a cylinder block, as well as the objectives of dimensional control of the corresponding barrels, in particular when said bearings comprise liners inserted during casting.

To this end, the invention proposes, according to a first aspect, a method for casting a part made of a metal alloy such as an aluminum alloy, and very specifically for casting a cylinder block for an internal combustion engine, characterized in that it includes the following steps:

forming a core having at least one barrel intended to form a cylinder in the part and at least one cavity intended to form, in the part, a bearing and/or retaining zone for a working component such as a crankshaft, and at least one cooling unit in close proximity to the cavity, positioning the core in a metal mold cavity, and feeding the mold lined with its liquid alloy core by gravity.

Some preferred but non-limiting aspects of the method according to the invention are the following:

the core is formed by the rigid assembly of a set of core segments, the core is positioned by positioning the individual segments in the mold in reference positions with respect to the mold, then by rigidly connecting the segments to one another, the segments are rigidly connected to one another by attaching one or more shoulders to the segments, the segments are rigidly connected to one another by bringing them into abutment at the level of bearing surfaces, the bearing surfaces are provided at the cooling units belonging to the respective segments, the or each cooling unit is integrated to the core during the formation of said core, the or each cooling unit is inserted into the core after said core has been formed, the or each cavity is at least partially defined by a cooling unit, the or each cooling unit provided in the core is located in an area of the core opposite an area of risers in the mold, and the cooling unit or at least one cooling unit abuts a die shoe of the mold.

According to a second aspect, the present invention proposes a mold for casting a part made of a metal alloy such as an aluminum alloy, and very specifically the casting of a cylinder block for an internal combustion engine, characterized in that it includes:

a metal shell defining a mold cavity, a core having at least one barrel intended to form a cylinder in the part and at least one cavity intended to form, in the part, a bearing and/or retaining zone for a working component such as a crankshaft, and at least one cooling unit in close proximity to the cavity, means for positioning the core in the mold cavity, and a risering in an upper area of the mold for feeding the liquid alloy by gravity.

Some preferred but non-limiting aspects of the mold defined above are the following:

the core includes rigid assembly of a set of core segments, the means for positioning the core are capable of positioning the individual segments in the mold in reference positions with respect to the mold, and means for rigidly connecting the segments to one another are provided, the core includes one or more shoulders attached to the segments and capable of rigidly connecting the segments to one another, the core segments include mutual bearing surfaces for said segments, the bearing surfaces are provided at the cooling units belonging to the respective segments, the or each cooling unit is integrated to the core during the formation of said core, the or each cooling unit is inserted into the core after said core has been formed, the or each cavity is at least partially defined by a cooling unit, the or each cooling unit provided in the core is located in an are of the core opposite a riser area of the mold, the cooling unit or at least one cooling unit abuts a die shoe of the mold, and the mold shell is free of cooling circuits.

BRIEF DESCRIPTION OF THE DRAWINGS

Other aspect, objectives and advantages of the present invention are described below in terms of a preferred embodiment, by way of a non-limiting example and with reference to the appended drawings in which, in addition to FIGS. 1 and 2, which have already been described.

DETAILED DESCRIPTION

Figure 3A:
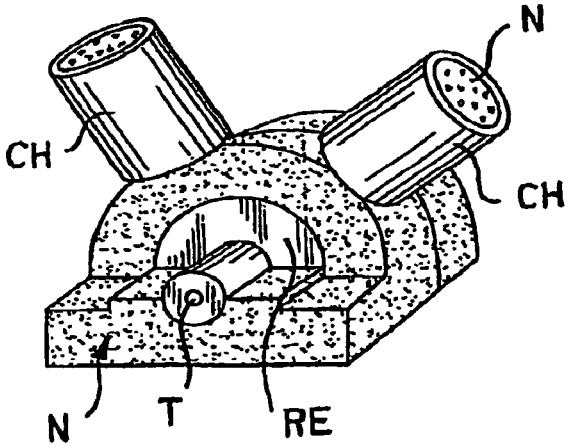
FIGS. 3*a* and 3*b* are schematic perspective view of two possibilities for providing a bundle of cores that can be used in a method according to the invention.

First, FIG. 3*a* shows a central bundle of cores intended to participate in the casting of a V-shape cylinder block of a combustion engine, in which said cylinder block comprises liners CH and cooling units RE integrated when the core is drawn.

More specifically, this bundle comprises, at the end intended to form the crankshaft, a cooling system consisting of volumes of steel, cast iron, or any other suitable metal or alloy, forming cooling units RE. These cooling units are placed in core boxes used to form the different bundles of cores (generally, one bundle per pair of cylinders).

FIG. 3*a* shows a cooling unit RE, as well as two cylinder liners CH, in which the core N is drawn around the cooling unit and inside the liners.

In this case, the cooling unit has a central hole T that enables a threaded rod or the like to pass through the aligned cooling units, in which said rod facilitates the tightening and rigidification of the central bundle of cores as well as its extraction after the casting.

Figure 3B:
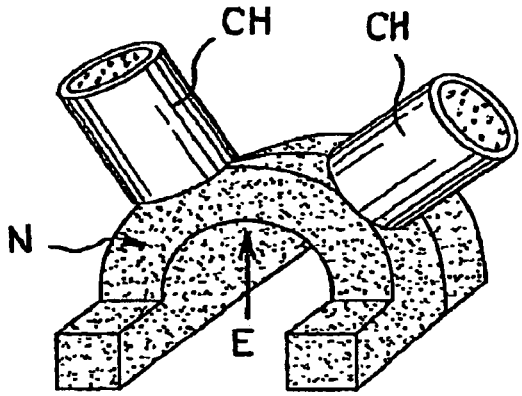

FIG. 3*b* shows an alternative embodiment of the core-making system, in which a recess E, which is provided in the bundle of cores, is intended to receive, after the formation of the cores, a metal cooling unit system provided at the die shoe (not shown in FIG. 3).

Figure 4:
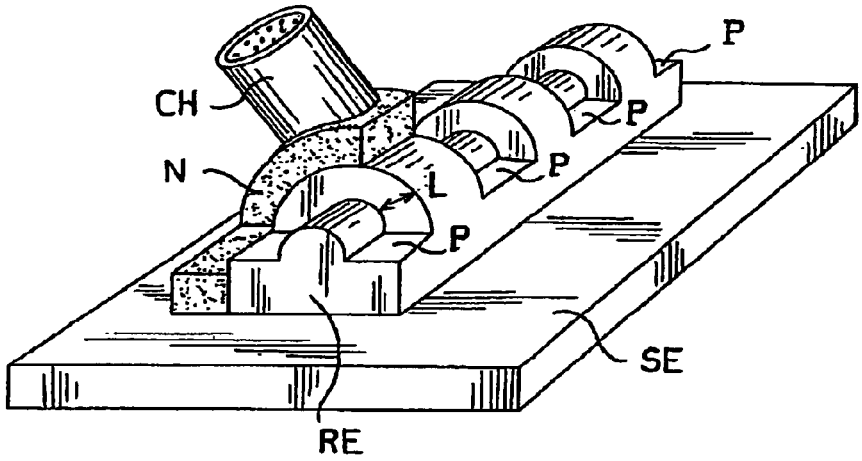
FIG. 4 is a schematic partial perspective view of a die shoe and a cooling unit belonging to a mold according to the invention.

FIG. 4 partially shows a bundle of cores conforming to FIG. 3*b*, as well as the die shoe SE of the mold comprising a single cooling unit RE received in the aligned recesses of the core segments. Several cooling units can also be arranged in contact with one another. In FIG. 4, the recesses P formed in the cooling unit RE constitute spaces intended to form the crankshaft bearings.

It should be noted that the cooling surfaces are advantageously designed to maximize the generally semi-circular vertical surface for contact with the bearings, so as to accelerate insofar as possible the cooling of the liquid alloy in the areas P tat will form bearings, and thus to obtain optimal mechanical features in these areas.

In particular, the distance L shown in FIG. 4 is preferably greater than 15 mm.

The mold also comprises a risering system located opposite the aforementioned cooling system, in which the riser are typically formed by sand cores. The liquid alloy feeds the mold by tilting across the risers, so as naturally to obtain a thermal gradient favorable to solidification, with the highest temperature at the risers and the lowest temperature in the opposite area.

Figure 5:
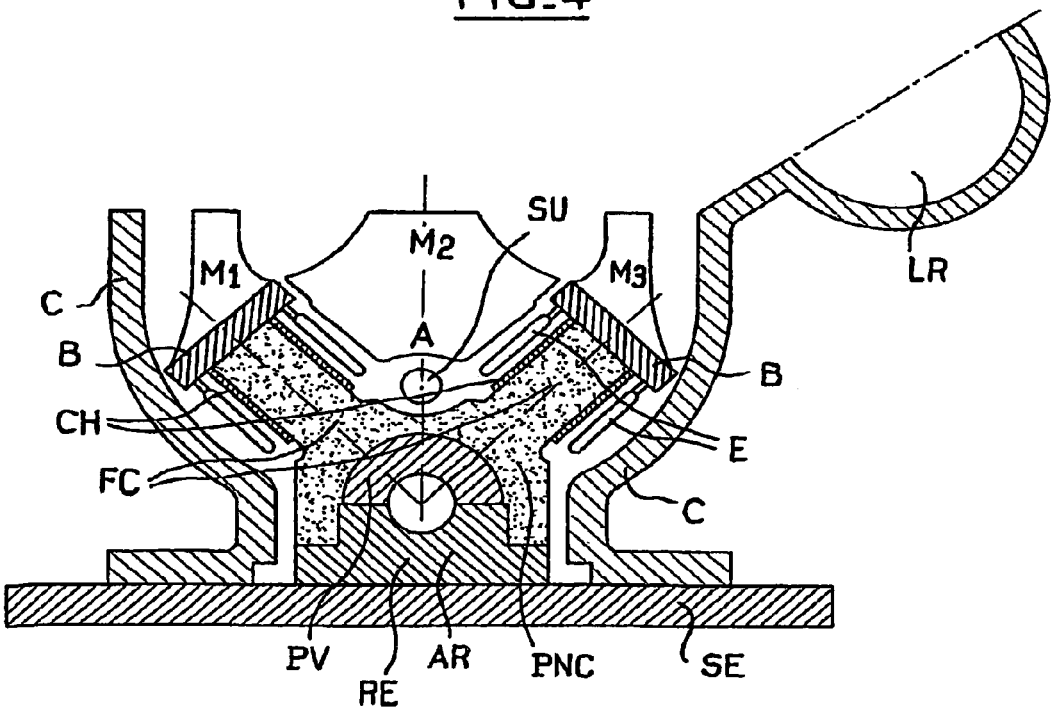
FIG. 5 is a cross section view of a mold according to the invention.

In this regard, FIG. 5 shows the entire structure of the mold and the cast part.

The mold comprises its die shoe SE, two cheeks C mobile in the directions indicated by the arrows Fc (i.e., the axis of the liners CH) in figure 5, vertically-mobile slide valves (not shown), a relay ladle LR connected to one of the cheeks C, a central bundle of cores PNC, risering cores M1, M2 and M3, and additional cores as necessary.

The assembly may tilt around a horizontal axis A so as to gradually fill by tilting, from the relay ladle LR.

FIG. 5 also shows shoulders B, sleeves CH in which the cylinder drums FC of the bundle of cores are formed, on which the shoulders B (made of a metal) are glued or otherwise attached, and cores B for passages allowing water to circulate. The crankshaft bearing zones are designated by PV, while the reference AR designates the bearing surface between adjacent segments of the core, at the level of the cooling unit RE. This contact between the segments also occurs at the shoulders B.

Finally, the central core on the whole consists in the assembly of the different core segments, abutting one another at the level of bearing surfaces AR, and in the attachment by adhesion, screwing or the like, of the shoulders B, on which the cores E, provided for the passage of water, will have previously been attached.

Such an assembly results in a central core system with very good rigidity, and therefore good dimensional characteristics of the shapes inside the cylinder block.

This core system also forms a "cage" structure closed by the shoulders B and the bearing zones AR.

Figure 6:
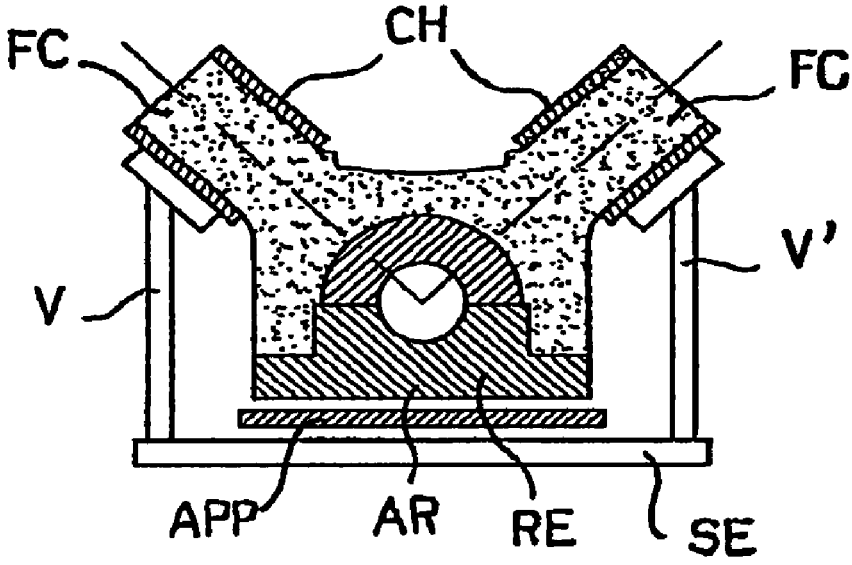
FIG. 6 shows a cross section view of a step of positioning a bundle of cores in the mold.
Figure 7:
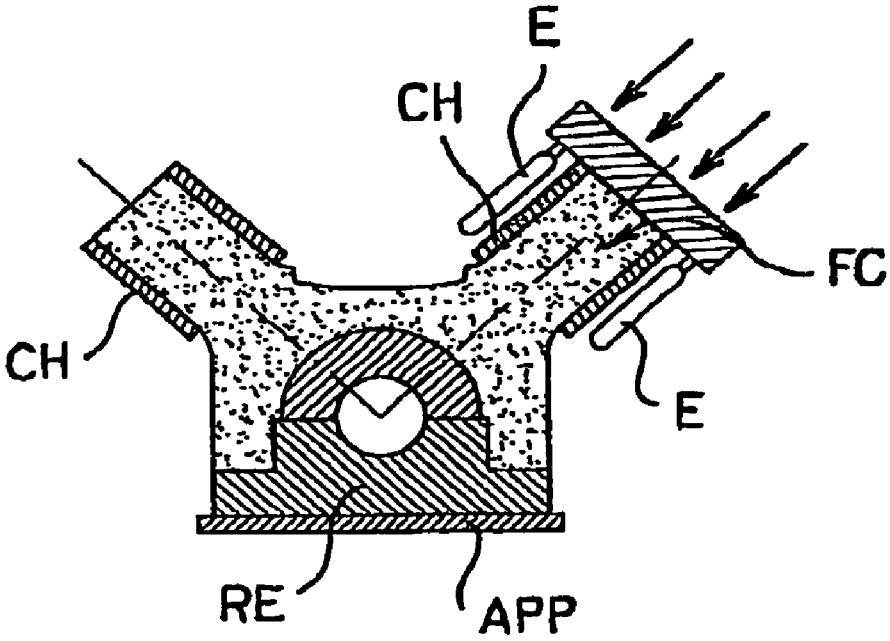
FIG. 7 shows a cross section view of a step of attaching a shoulder to the bundle of cores.

The proper positioning of the core structure as described above shall now be described in reference to FIG. 6. This figure shows two lateral supports V and V' which first enable the liners CH to be aligned with one another from one core segment to another, even though these segments have not yet been rigidly connected to one another. After this reference position is arranged, it is immobilized by any suitable means at the bearing surfaces AR of the different segments. The lateral supports V and V' are then retracted downwardly so as to release the segments. The assembly is completed as shown in FIG. 7, by positioning the shoulders B and attaching them to the barrels FC, while the base of the bundle of cores is glued or attached to a reference bearing APP at the die shoe SE of the mold.

EXAMPLE a) according to the prior art

A V8 cylinder block with a displacement of 5.7 liters is cast with an aluminum alloy with the following composition: Fe (0.35%) Si (7.3%) Cu (3.3%) Zn (0.20%) Mg (0.30%) Mn (0.14%), with the remainder being aluminum, at a temperature of 735° C., according to the conventional gravity casting method per se.

Figure 1:
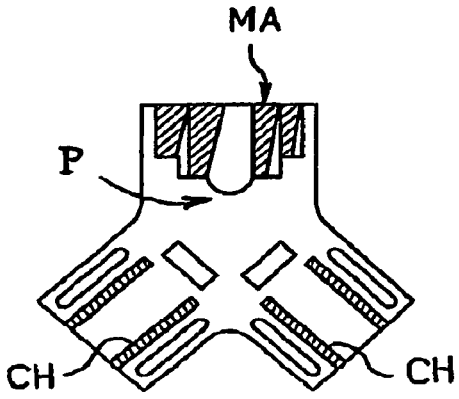
Figure 2:
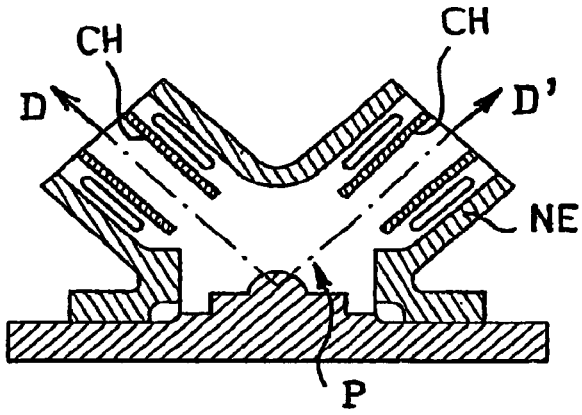

The mold is positioned in advance with the crankshaft bearings upward, under the risers, as described in reference to FIG. 2 (prior art).

The core has cast iron liners machined on their internal and external surfaces. The entire mold is metal, and the liners are supported by barrels that are retractable through the die shoe.

The block after casting is cooled by pulsed air and mechanically decored, then subjected to a heat treatment that is known per se, for 5 hours at a temperature of 210° C. (treatment known to a person skilled in the art by the designation "T5").

In the crankshaft bearings, for a representative group, the mechanical features indicated in table I below are obtained.

TABLE I

| | Rm (Mpa) | Rpo2 (MPa) | A (%) | HB |
|---|---|---|---|---|
| Mean | 243 | 226 | 0.40 | 101 |
| Standard deviation | 5.5 | 5.6 | 0.05 | 2.0 |

b) according to the invention

A cylinder block having the same shape is produced with the same alloy and the same temperature, with the method according to the invention, with an arrangement for cooling the alloy at the level of the bearings as described in reference to FIG. 3*b*.

The sleeves are identical to those of the example according to the prior art.

After cooling with pulsed air, the same heat treatment (5 h at 210° C.) is conducted.

Table II below gives the mechanical properties obtained in this case for a representative group.

TABLE II

| | Rm (Mpa) | Rpo2 (MPa) | A (%) | HB |
|---|---|---|---|---|
| Mean | 291 | 222 | 2.0 | 116 |
| Standard deviation | 4.5 | 5.0 | 0.06 | 2.0 |

The comparison of tables I and II shows the improvement of the mechanical properties, measured in both cases at the level of the bearings, in the same location thereof.

In particular, an increase in the mechanical strength Rm of approximately 20%, and a five-fold increase in elongation are observed.

Moreover, the method according to the invention results in a standard deviation in terms of positioning of the liners with respect to the reference frame of the block equal to 0.22 mm (mean standard deviation for all of the barrels), substantially lower than the standard deviation of 0.25 mm obtained with the method of the prior art.

Of course, a person skilled in the art can apply numerous alternatives and modifications to the invention.

The invention claimed is:

1. A method for casting a cylinder block made of a metal alloy for an internal combustion engine, comprising:

forming a core assembly having a plurality of barrels, each barrel having a liner therearound and intended to form respective cylinders in the part, crankshaft bearing zones and at least one cooling unit in a region opposite the barrels, positioning the core assembly in a mold cavity defined by a metallic mold shell, the cooling unit is located at a bottom portion of said core assembly, further positioning in an upper region of the mold cavity at least one risering core, and filling the mold cavity by gravity through said at least one risering core.

2. The method according to claim 1, wherein said filling is performed by tilting the mold through a predetermined angle, said mold including a relay ladle.

3. The method according to claim 1, wherein positioning the core assembly in the mold cavity comprises abutting said at least one cooling unit against a die shoe of the mold.

4. The method according to claim 1, wherein the mold shell is free of any cooling circuit.

5. The method according to claim 1, wherein said at least one risering core is a sand core.

6. The method of claim 1, wherein said core assembly is formed by rigidly connecting together a set of core segments each including at least one barrel surrounded by a liner and a crankshaft bearing zone, said core assembly further including at least one cooling unit.

7. The method according to claim 6, wherein the core is positioned by positioning the individual segments in reference positions with respect to the mold, then by rigidly connecting the segments to one another in these positions.

8. The method of claim 7, wherein said reference positions are defined by bearing surfaces in the vicinity of the crankshaft bearing zones and liner alignment support members.

9. The method of claim 8, wherein the segments are rigidly connected to one another by bringing them into abutment at mutual bearing surfaces.

10. The method of claim 9, wherein each segment includes a respective cooling unit belonging to a respective core segment, said mutual bearing surfaces are provided at the cooling units.

11. The method of claim 1, further comprising:

forming each of a plurality of sand core segments by placing at least one liner in an upper area of a core box and then building the core, each segment including at least one barrel surrounded by the liner and a crankshaft bearing zone; and forming a core assembly by rigidly connecting together a set of said core segments, said core assembly further including at least one cooling unit.

12. The method according to claim 11, wherein the forming the plurality of core segments includes placing a cooling unit in a predetermined position in said core box.

* * * * *